US005092019A

United States Patent [19]

Levy

[11] Patent Number: 5,092,019

[45] Date of Patent: Mar. 3, 1992

[54] MAGNETIC JEWELRY CLOSURES WITH SAFETY FEATURES

[76] Inventor: Davida Levy, 1340 Biscaya Dr., Surfside, Fla. 33154

[21] Appl. No.: 688,102

[22] Filed: Apr. 19, 1991

Related U.S. Application Data

[63] Continuation-in-part of Ser. No. 536,777, Jun. 12, 1990, Pat. No. 5,008,984.

[51] Int. Cl.[5] ..... A44B 21/00

[52] U.S. Cl. ..... 24/303; 24/616

[58] Field of Search ..... 24/303, 616, 615, 618, 24/94, 688, 49 M; 292/251.5; 248/206.5

[56] References Cited

U.S. PATENT DOCUMENTS

| | | | |
|---|---|---|---|
| 807,069 | 12/1905 | Geoffroy | 24/616 |
| 1,807,293 | 5/1931 | Keller | 24/616 |
| 2,178,572 | 11/1939 | Forstner | 24/616 |
| 2,623,256 | 12/1952 | Feibelman | 24/303 |
| 2,648,884 | 8/1953 | Loofboro | 24/303 |
| 2,654,929 | 10/1953 | Feibelman | 24/616 |
| 2,901,278 | 8/1959 | Robinson | 292/251.5 |
| 3,129,477 | 4/1964 | Mizuno | 24/303 |
| 3,897,288 | 7/1975 | Fayling | 24/303 |
| 4,170,809 | 10/1979 | Geldwerth et al. | 24/616 |
| 4,881,305 | 11/1989 | Rivera | 24/616 |

*Primary Examiner*—Victor N. Sakran

*Attorney, Agent, or Firm*—Fleit, Jacobson, Cohn, Price, Holman & Stern

[57] ABSTRACT

A jewelry closure includes a pair of magnetic closure members for magnetically engaging together and a mechanical closure which acts as a second closure or safety feature. One or both closure members includes a magnet. A first closure member of the pair is supported by a casing which extends outwardly to receive the second closure member for magnetic engagement of the members. A mechanical closure acts as a safety feature preventing the two members from being readily separated. The mechanical closure may include screw threaded portions on both the casing and the second closure member or may include a push-click mechanism on the casing and second closure member.

12 Claims, 2 Drawing Sheets

MAGNETIC JEWELRY CLOSURES WITH SAFETY FEATURES

RELATED APPLICATION

This application is a continuation-in-part of Ser. No. 536,777, filed June 12, 1990, now U.S. Pat. No. 5,008,984.

FIELD OF THE INVENTION

The invention relates to magnetic jewelry closures.

BACKGROUND OF THE INVENTION

Known jewelry closures may be hard to close, particularly for young, elderly and/or disabled users. A known magnetic closure is that shown in Mizuno, U.S. Pat. No. 3,129,477. Particularly when used for heavy or valuable jewelry, there may be a perceived lack of strength of the magnetic closure due to the absence of a safety closure in addition to the magnetic closure.

SUMMARY OF THE INVENTION

A clasp or closure of the invention, for jewelry, such as necklaces, bracelets and anklets, and for hair accessories, such as pony tail holders, and for belts and other clothing accessories, includes a pair of magnetic closure members for magnetically engaging together to join the ends of the jewelry or other item to be closed. One or both closure members may include a magnet. The first closure member is supported in a casing which extends outwardly to receive the second closure member enabling both closure members to be magnetically engaged together. After magnetic engagement, the members are then mechanically engaged together, providing a second closure which operates as a safety feature for the jewelry clasp.

In one embodiment of the invention, the second closure member engages magnetically with the first closure member and screws threads on the outer surface of the second closure member are then engaged with corresponding screw threads on the inner surface of the casing to form a safety closure. In order for the second closure member to be screwed inwardly while magnetically engaged with the first closure member, a resilient member, such as a leaf spring or a foam cushion, is secured in the base of the cylindrical casing. The spring or foam cushion is depressed as the second closure member is threadedly engaged with the casing. The second closure member must be unscrewed before the magnetic engagement can be released.

In another embodiment, the second closure member engages with the casing in a push-click step. As described above, the first closure member is mounted resiliently, such as on a spring or foam cushion secured in the base of the cylindrical casing and the spring or foam cushion is depressed as the second closure member is engaged with the casing after the magnetic engagement has been completed. An annular protrusion extending from the outer surface of the second closure member is pushed over a plurality of protrusions on the inner surface of the casing, forming a safety closing in addition to the magnetic closing. To release the clasp, the second closure member is pulled outwardly which disengages the push-click protrusions from each other and then disengages the magnetic engagement of the closure members.

In each of these embodiments, the closure includes a mechanical means of engagement which acts as a safety feature in addition to the initial magnetic engagement of the two parts.

It is an object of the invention to provide a magnetic jewelry closure including a mechanical closure as a safety feature which prevents ready separation of the closure members.

It is another object of the invention to provide a magnetic jewelry closure including a screw-threaded mechanical safety feature.

It is a further object of the invention to provide a magnetic jewelry closure including a push-click mechanical safety feature.

DETAILED DESCRIPTION OF THE INVENTION

This application is a continuation-in-part of U.S. patent application, Ser. No. 536,777, filed June 12, 1990, the entire disclosure of which is incorporated herein by reference.

The invention is a jewelry closure or clasp in which a pair of closure members are attracted together by magnetic forces. The closure is secured by a safety feature which holds the closure firmly in place until positive force is applied, to open the closure. The magnetic members cannot be accidentally separated from each other. One or both of the closure members may include a magnet, and if only one member includes a magnet, the other member includes material, such as iron or steel, attracted to and held by the magnet of the magnetic member.

A closure of the invention may be used to join any jewelry or clothing for which it is appropriate, and is particularly useful for closing necklaces, bracelets, anklets and belts. Closures may also be used for hair accessories, such as pony tail holders or other hair retainers. One member of the closure is carried by each end of the jewelry, article of clothing or hair retainer and the parts are joined magnetically by simply bringing the members together The safety closure is engaged either by screwing the two parts into tight connection or by pushing the inserted member until it clicks into place.

Due to the magnetic attraction between the members of the closure, the members seek each other and even if the user is infirm or disabled, the jewelry may be closed effortlessly. Because the members seek each other, it is simple to screw the second closure member into the casing or to push the second member until it clicks into engagement with the protrusion on the casing, assuring the wearer that the closure is securely fastened.

Figure 1:
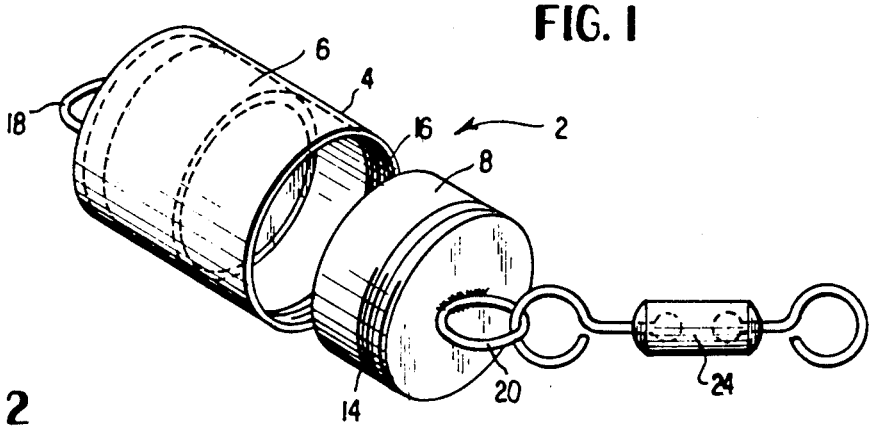
FIG. 1 is a perspective view of a combined magnetic and screw closure of the invention.

With reference to the Figures, in which like numerals represent like elements, FIG. 1 illustrates cylindrical jewelry closure 2, having the two parts separated. As shown in more detail in FIGS. 2 and 3, jewelry closure 2 includes a cylindrical casing 4 which encloses first closure member 6 and which also surrounds second closure member 8 when the closure is secured. First closure member 6 includes magnet 3 and magnet holder 5. Second closure member 8 includes magnet 7 and magnet holder 9. As discussed above, either magnet 3 or magnet 7 may be magnetically attracted material. It is generally preferred that the closure include two magnets.

First closure member 6 is secured to a resilient member, such as resilient foam cushion 10, which is secured to base 12 of cylindrical casing 4. The foam cushion may be secured to casing 4 and first closure member 6 by using an adhesive, by welding or by other method known in the art. Resilient foam cushion 10 may be made of fine-celled, cross-linked, low density polyethylene foam or other resilient foamed plastic known in the art. Second closure member 8 is inserted into cylindrical casing 4 and engaged magnetically therewith. Then second closure member 8 and cylindrical casing 4 are engaged together by engaging screw threads 14 on closure member 8 and screw threads 16 on casing 4. The screw threads may be positioned in any complementary positions on casing 4 and second closure member 8 which enable the second closure member to be screwed into the casing, forming a mechanical safety closure in addition to the magnetic closure formed between the first and second closure members. Rings 18, 20 are attached to or molded with end 12 of casing 4 and end 22 of closure member 8, respectively. Jewelry is attached by means of rings 18 and 20.

In order to avoid twisting a necklace, bracelet, belt, hair retainer or other article while the two parts of the closure are being screwed together, a swivel joint, such as swivel joint 24, may be attached to each of rings 18, 20. Swivel joint 24 allows free rotation of any article attached thereto, without twisting. Other swivel joints suitable for this application will be apparent to those skilled in the art. A swivel may be attached to one or preferably both rings.

Figure 3:
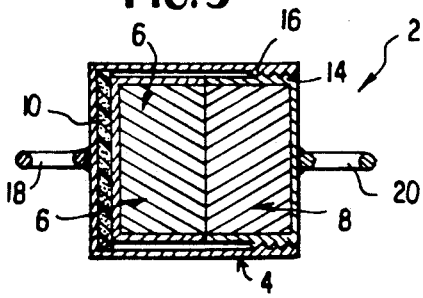
FIG. 3 is an elevational view, shown in cross-section, of the closure of FIG. 2 after the parts are engaged together.

FIG. 3 shows jewelry closure 2 in joined configuration. Foam cushion 10 is compressed after members 6 and 8 are first joined magnetically and then joined mechanically by screwing closure member 8 and casing 4 together.

Figure 2:
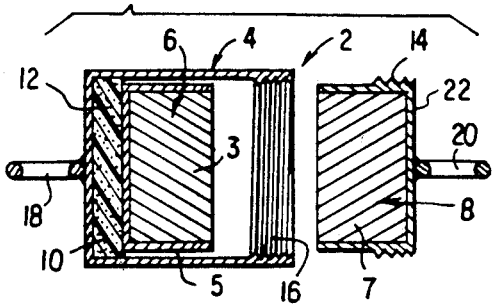
FIG. 2 is an elevational view, shown in cross-section, of a closure of FIG. 1 before the parts are engaged together.
Figure 4:
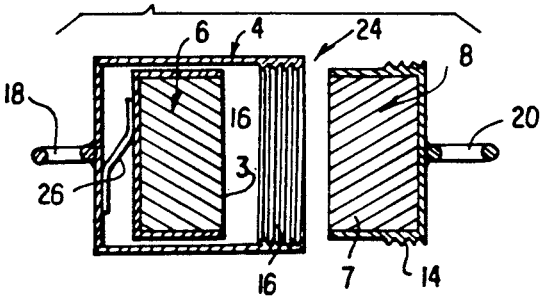
FIG. 4 is an elevational view, shown in cross-section, of another closure of FIG. 1 before the parts are engaged together.
Figure 5:
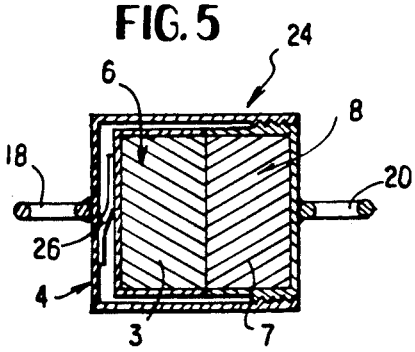
FIG. 5 is an elevational view, shown in cross-section, of the closure of FIG. 4 after the parts are engaged together.

FIGS. 4 and 5 illustrate a jewelry closure 24 in which all parts and the method of using the closure are the same as in the embodiment of FIGS. 2 and 3 except that foam cushion 10 is replaced by spring 26. Spring 26 is illustrated as a leaf spring. A coil spring or other type of spring known in the art may be used in place of leaf spring 26. Spring 26 is in an uncompressed state before the jewelry closure 24 is secured and is in compressed state after jewelry closure 24 is closed both magnetically and mechanically.

Figure 6:
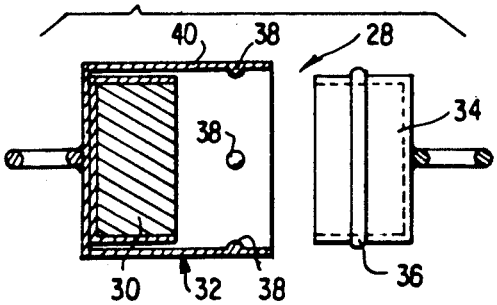
FIG. 6 is an elevational view, shown in cross-section, of another closure before the parts are engaged together.
Figure 7:
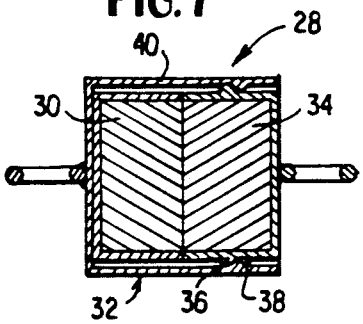
FIG. 7 is an elevational view, shown in cross-section, of the closure of FIG. 6 after the parts are engaged together.

FIGS. 6 and 7 illustrate an embodiment of the invention in which the two parts of the closure are closed together using a push-click mechanical engagement in addition to the magnetic engagement described above. The parts of the closure are similar to those described above with respect to the embodiments of FIGS. 1 to 5.

FIGS. 6 and 7 illustrate jewelry closure 28 including first closure member 30 held by casing 32 and second closure member 34 which is inserted into casing 32 for engagement. Closure member 34 is formed with annular protrusion 36 therearound. Protrusions 38 are positioned at a plurality of positions around the inner circumference of side wall 40 of casing 32. In use, second member 34 is inserted into casing 32 and the parts are joined both magnetically and mechanically by pushing ring 36 over protrusions 38. The user knows when the two parts are properly engaged by the feel of ring 34 being engaged over protrusions 38 and/or by an audible click. Closure member 28 is preferably made of molded plastic to provide sufficient resilience in the push-click engagement of ring 36 with protrusions 38. Appropriate plastic materials for molding will be known to those skilled in the art.

FIGS. 8 to 11 illustrate further jewelry closures of the invention which include a resilient member, as shown in FIGS. 2 to 5, and a push-click mechanism, as shown in FIGS. 6 to 7. Jewelry closures of FIGS. 8 to 11 are preferably made of plastic to provide the necessary resiliency.

Figure 8:
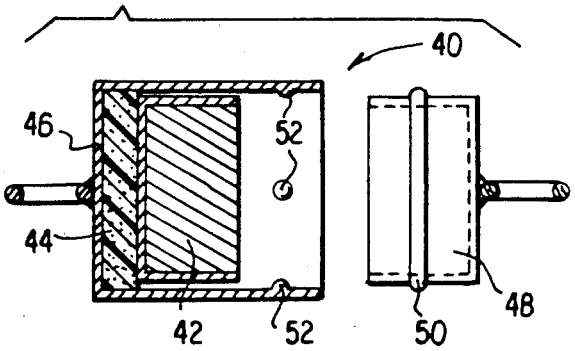
FIG. 8 is an elevational view, shown in cross-section, of another closure before the parts are engaged together.
Figure 9:
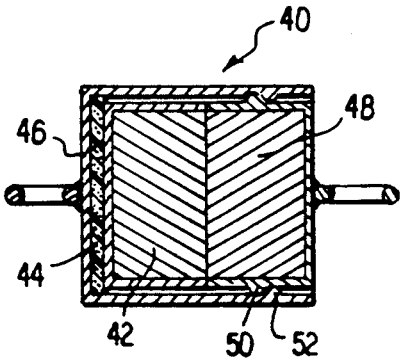
FIG. 9 is an elevational view, shown in cross-section, of the closure of FIG. 8 after the parts are engaged together.

Jewelry closure 40, shown in FIGS. 8 and 9, includes first closure member 42 adhesively secured to resilient member 44, which may be a foamed plastic cushion. Member 44 is adhesively secured to casing 46, as discussed above and shown in FIGS. 2 and 3. Second closure member 48 includes annular ring 50 molded circumferentially around an outer surface thereof. Protrusions 52 are molded at a plurality of places on the inner surface of casing 46. In use, second closure member 48 is inserted into casing 46 and magnetically engaged with first closure member 42. Second closure member 48 is then pushed further into casing 46, compressing resilient member 44, and protrusions 50 and 52 engage together in a push-click engagement, as discussed above with respect to FIGS. 6 and 7.

Figure 10:
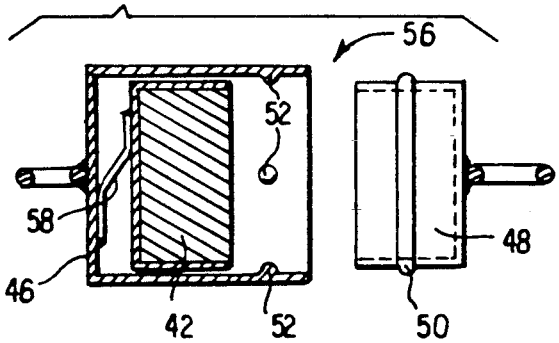
FIG. 10 is an elevational view, shown in cross-section, of another closure before the parts are engaged together.
Figure 11:
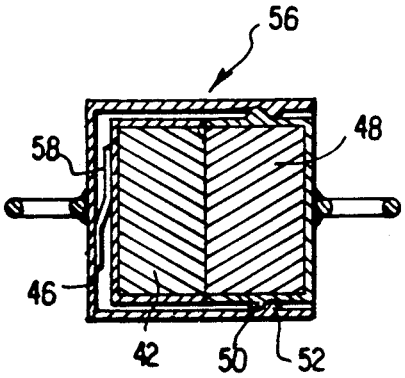
FIG. 11 is an elevational view, shown in cross-section, of the closure of FIG. 10 after the parts are engaged together.

FIGS. 10 and 11 similarly show jewelry closure 56 in which resilient member 44 is a spring 58 attached both to first closure member 42 and casing 46. Second closure member 48 engages magnetically and then mechanically with first closure member 42.

The jewelry closure has been described as having an annular protrusion around the second closure member and a plurality of protrusions on the cooperating portion of the inner surface of the casing. The annular portion may alternatively be on the casing and the plurality of protrusions on the second closure member. While an annular protrusion on the second closure member and a plurality of circular protrusions on the casing have been illustrated in FIGS. 6 to 11, this is a non-limiting example and the various protrusions may be elongated, oval or other shape which allows the portion on the second closure member to be pushed past and mechanically engaged with the cooperating portion on the casing.

To open the jewelry closures shown in FIGS. 6 to 11, the user pulls the two halves apart, separating the mechanical closure add then the magnetic closure.

The jewelry closure is preferably of circular cross-section and the screwed embodiment must be of circular cross-section. Although the push-click embodiment may be of square or oval cross section or other appropriate shape, a circular cross section is preferred. A closure of the invention may be any size and shape as long as the faces of the first and second closure members are joined magnetically and also fasten securely together mechanically to hold the decorative items in closed position. Other shapes for the jewelry closure will be apparent to those skilled in the art. The shape of the closure is not limited to the examples illustrated herein.

The closures described may be used with any type of jewelry, such as chains, strings of beads, or other jewelry. Various pieces of jewelry may be joined together, firmly and with great versatility, using these closures. The closures may also be used for clothing, belts, hair accessories or for other uses. The closures may be made of any appropriate material, such as metal or plastic.

If a plastic closure is used, the cylindrical casing and casings for the magnetic members are plastic and the threads or push-click protrusions are molded therein. The closure may be color coordinated with the article being closed. If the closure is made of metal, it may be color toned with the jewelry or other articles being joined and, likewise, the screw threads and push-click protrusions are molded therein.

While the invention has been described with respect to certain embodiments thereof, variations and modifications may be made not departing from the spirit and scope of the invention.

What is claimed is:

1. A jewelry closure comprising:

a magnetic closure comprising first and second closure members for engaging together magnetically, wherein at least one of said first and second closure members comprises a magnet;

a casting for supporting said first closure member and extending outwardly for engaging said second closure member; and a mechanical closure on said casing for engaging said second closure member when said second closure member is held by magnetic attraction to said first closure member, wherein said mechanical closure comprises screw threads on said casing for engaging with complementary screw threads on said second closure member;

wherein both said magnetic closure and said mechanical closure must be released in order to open the jewelry closure.

2. A jewelry closure according to claim 1 wherein said first closure member and said casing are separated by a resilient member.

3. A jewelry closure according to claim 2 wherein said resilient member comprises a foam plastic member.

4. A jewelry closure according to claim 3 wherein opposite sides of said foam plastic member are adhered to said first closure member and to said casing respectively.

5. A jewelry closure according to claim 2 wherein said resilient member comprises a spring.

6. A jewelry closure according to claim 5 wherein opposite ends of said spring are adhered to said first closure member and said casing respectively.

7. A jewelry closure comprising:

a magnetic closure comprising first and second closure members for engaging together magnetically, wherein at least one of said first and second closure members comprises a magnet;

a casing for supporting said first closure member and extending outwardly for engaging said second closure member; and a mechanical closure on said casing for engaging said second closure member when said second closure member is held by magnetic attraction to said first closure member, wherein said mechanical closure comprises an annular protrusion extending circumferentially around an outer surface of said second closure member and a plurality of protrusions extending around an inner surface of said casing whereby said second closure is pushed into said casing and said annular protrusion is pushed past said plurality of protrusions to form a mechanical engagement between said second closure member and said casing;

wherein both said magnetic closure and said mechanical closure must be released in order to open the jewelry closure.

8. A jewelry closure according to claim 7 wherein said first closure member and said casing are separated by a resilient member.

9. A jewelry closure according to claim 8 wherein said resilient member comprises a foam plastic member.

10. A jewelry closure according to claim 9 wherein opposite sides of said foam plastic member are adhered to said first closure member and to said casing respectively.

11. A jewelry closure according to claim 8 wherein said resilient member comprises a spring.

12. A jewelry closure according to claim 11 wherein opposite ends of said spring are adhered to said first closure member and said casing respectively.

* * * * *